United States Patent [19]

Wineburner et al.

[11] 4,140,027

[45] Feb. 20, 1979

[54] LEVER MECHANISM

[75] Inventors: Ronald E. Wineburner, Pekin; Norman R. Allen, Washington, both of Ill.

[73] Assignee: Caterpillar Tractor Co., Peoria, Ill.

[21] Appl. No.: 815,386

[22] Filed: Jul. 13, 1977

[51] Int. Cl.[2] ..... G05G 9/00; G05G 13/00

[52] U.S. Cl. ..... 74/471 R

[58] Field of Search ..... 74/107, 25, 53–55, 74/469–471, 471 XY, 473

[56] References Cited

U.S. PATENT DOCUMENTS

| | | | |
|---|---|---|---|
| 2,967,436 | 1/1961 | Steinlein | 74/471 R |
| 3,530,736 | 9/1970 | Honk | 74/471 R X |
| 3,541,876 | 11/1970 | Gressard | 74/471 R |
| 3,940,674 | 2/1976 | Gill | 74/471 XY |

*Primary Examiner*—James T. McCall
*Assistant Examiner*—Terrell P. Lewis
*Attorney, Agent, or Firm*—Phillips, Moore, Weissenberger, Lempio & Majestic

[57] ABSTRACT

A single control lever mounted on a pivot assembly is movable in an arc in first and second directions in one plane to impart motion through a cam arrangement to a first push rod and cable assembly so that the first push rod and cable assembly moves proportionally to the movement of the lever in either the first or second direction. The same control lever is movable in an arc in third and fourth directions in a second plane normal to the first plane to impart longitudinal motion to a second push rod and cable assembly affixed to the pivot assembly. A resilient means is incorporated in the pivot assembly to resiliently bias the single control lever to a neutral position in the first plane. A gating plate is affixed to the bracket supporting the pivot assembly and limits the travel of the single control lever to a predetermined path.

7 Claims, 5 Drawing Figures

18
A
B
C
D
10
86
4
4
20
24
22
38
42
52
78
48
46
40
50
44
82
66
14
16
80
12
68
70

LEVER MECHANISM

BACKGROUND OF THE INVENTION

This invention relates to a lever mechanism which may be affixed to a plurality of valve stems by appropriate cable and push rod assemblies for control thereof. In particular, it relates to a single control lever mounted in a bracket assembly which has generally linear travel to control at least two valve stems in a construction machine.

Control of hydraulic circuits in machinery, particularly construction machinery of the mobile type, for example, tracked vehicles, is generally accomplished through lever mechanisms. Operation of these various lever mechanisms is best accomplished with a minimum of change of directions of the lever during positioning in the various operating positions. For example, in a tracked vehicle having a winch mechanism affixed to the rearward end of the vehicle, it is appropriate to provide control of the winch by fore and aft movement of the winch control lever. A simple fore and aft motion is more appropriate for winch control in that the operator may observe the particular load being winched into or away from the winching vehicle without this attention being diverted to visually check the position of the control lever.

A problem with a single control lever in operation of various systems in a construction machine is controlling a plurality of valve stems. Such a plurality of valve stems may become necessary in the complex winch system described in the foregoing paragraph. In such systems, it is appropriate to select the direction of motion of the operated device and secondly, to control the rate at which the operated device is moved. Concurrently, a brake or clutch may be associated with the device which may also be operated by the same single control lever. Thus, a control lever would first select the direction of motion of the controlled device, release the associated brake or engage an operating clutch, and, finally, modulate fluid flow to the motor in accord with the desired rate of speed. To accomplish this in a two-directional lever mechanism requires a particularly unique design, since modulation control might necessarily be required in both directions of motion of the controlled machine.

Although this invention has been described in relation to a two-directional winch, it should be apparent to those skilled in the art that a single control lever to control a plurality of valve stems is not limited to such winch operation. Accordingly, this invention is equally applicable to any multi-valved hydraulic system for which a single control lever is necessary for control.

SUMMARY OF THE INVENTION

The present invention is directed to overcome one or more of the problems as set forth above.

Broadly stated, this invention is a lever mechanism comprising:

- a bracket and a lever mounted relative the bracket and movable relative the bracket in first and second normally oriented planes;
- a cam mechanism is associated with the lever for movement therewith in the first plane;
- a first apparatus is associated with the bracket and is movable in first and second opposite directions;
- a cam follower lever is associated with the bracket and the first apparatus. The cam follower lever is responsive to the cam mechanism to move the first apparatus in the first and second directions proportional to movement of the lever in the first plane;
- a second apparatus is associated with a bracket and is responsive to movement of the lever in the second plane for movement in the same first and second directions. The lever is resiliently biased to a center neutral position in the first plane.

DETAILED DESCRIPTION OF THE PREFERRED EMBODIMENT

Figure 1:
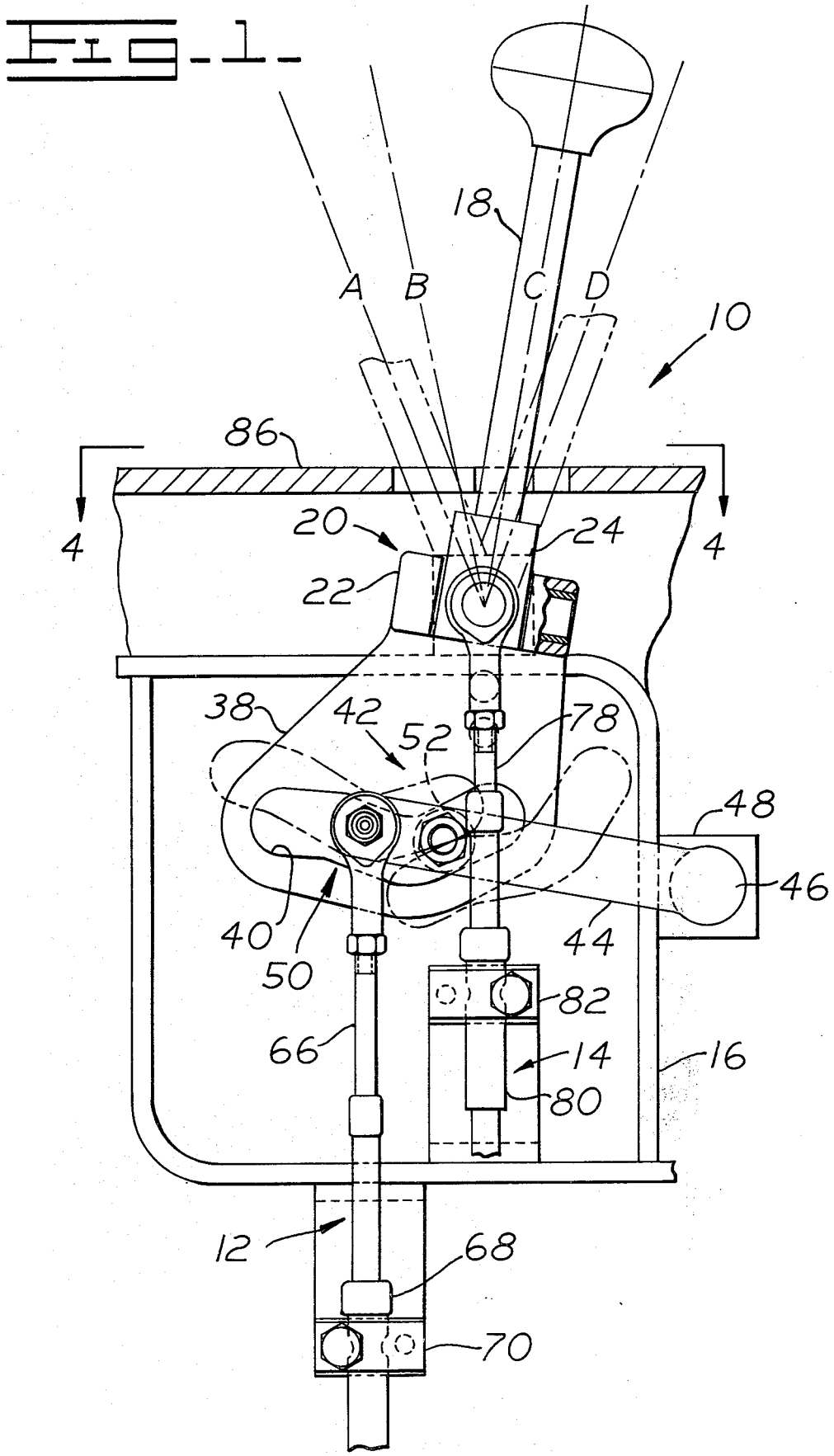
FIG. 1 is an elevational view of a lever mechanism embodying this invention, shown partly in section.

Shown in FIG. 1 is a lever mechanism 10 operable to actuate a first push rod assembly 12 and a second push rod assembly 14.

Lever mechanism 10 includes a mounting bracket 16 which may be affixed to a mechanical device such as a vehicle or the like (not shown). Mounting bracket 16 has associated therewith means for mounting a lever 18 which allows pivotal motion of lever 18 in two planes, specifically the plane illustrated by the plane of FIG. 1 and secondly the plane illustrated by the plane of FIG. 2. Such mounting means may be accomplished by a pivot assembly 20 which includes a bifurcated first member 22 pivotally mounted in mounting bracket 16 for rotation about an axis normal to the plane of FIG. 1. A second member 24 is pivotally mounted between the bifurcated portions of the first member 22 allowing rotation of second member 24 in an axis normal to the axis of rotation of first member 22. Lever 18 is affixed to second member 24 and if allowed to move freely, would be effectively gimbaled relative bracket 16.

First member 22 is formed with a shaft 26 which may be journaled by appropriate bearing means, such as sleeve bearing 28, in a bore 30 formed in a sleeve on the mounting bracket 16. Shaft 26 may have a threaded extreme end 32 to receive fastening means such as washer 34 and retaining nut 36.

Opposite threaded end 32, first member 22 has formed a subtending plate 38 in which a cam slot 40 having a particular shape is cut. A first apparatus such as push rod assembly 12 is associated at one end thereof with a cam follower arrangement 42.

Cam follower arrangement 42 includes a lever 44 pivotally connected to mounting bracket 16 by appropriate means, such as a shaft 46, journaled in a bearing member 48 affixed to mounting bracket 16. Lever 44 is affixed at the other opposite end to push rod assembly 12 by a ball and socket joint 50 which allows a degree of freedom to push rod assembly 12 relative to lever 44. Intermediate the ball and socket joint 50 and the end affixed to mounting bracket 16, is a cam follower 52 which may be of the conventional roller type and which is disposed in cam slot 40 to be moved thereby.

Disposed between mounting bracket 16 and subtending plate 38 is a resilient member 54 which may be in the form of a helical spring and which serves to bias subtending plate 38 and thus lever 18 to a center neutral position as indicated in FIG. 1 as position C. A first projecting pin 56 is secured to mounting bracket 16 and extends outwardly therefrom toward subtending plate 38. A second projecting pin 58 is mounted on subtending plate 38 and extends inwardly toward mounting bracket 16. Resilient member 54 is formed advantageously with bifurcated legs 60 and 62 (see FIG. 3) which effectively straddle pins 56 and 58 so that movement of pin 58 relative pin 56 acts against the biasing of resilient member 54. Such biasing of resilient member 54 tends to return pin 58 to the position indicated in full lines in FIG. 3, thus positioning lever 18 in the neutral position C as indicated in FIG. 1.

Figure 5:
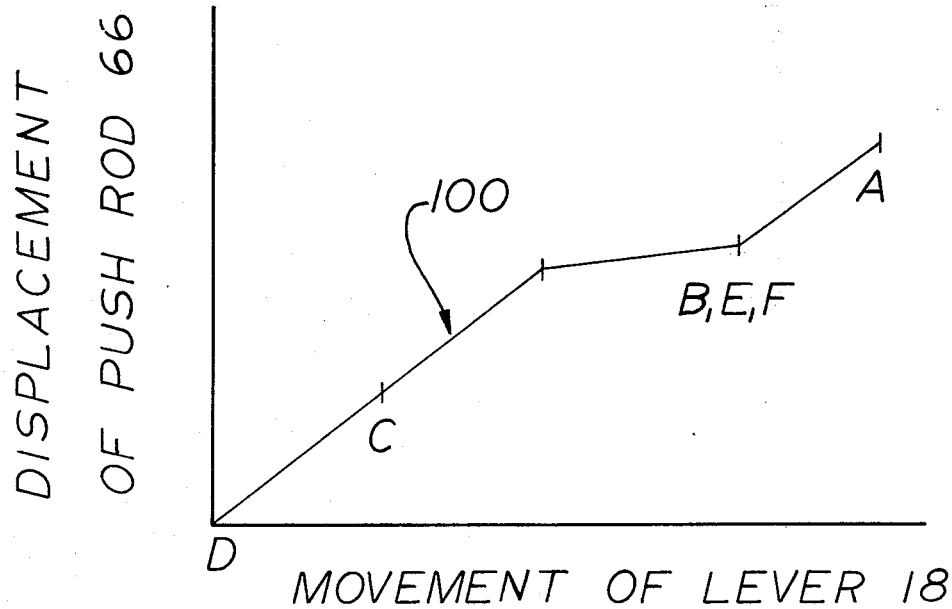
FIG. 5 is a graphical representation of the linear displacement of one of the push rods resulting from movement of the lever acting on the cam of this lever mechanism.

Push rod assembly 12 consists of a rod member 66 reciprocally mounted in a housing 68 which is affixed to bracket 16 by a subtending bracket 70. Thus it can be seen that rod member 66 reciprocates upwardly and downwardly responsive to the action of cam follower 52 acting on lever 44. FIG. 5 indicates a graph 100 which shows the displacement of push rod 66 in response to the movement of lever 18. The cam slot 40 illustrated in FIG. 1 gives a particular action to push rod 66 wherein the relative motion of push rod 66 is slowed during a certain portion of the displacement of lever 18. This has proved particularly useful in modulating various hydraulic devices wherein a larger displacement of lever motion is necessary in order to prevent early actuation of a particular hydraulic device, or, in another example, wherein a large lever displacement is appropriate during a modulation of a particular hydraulic device.

Actuation of second push rod assembly 14 is accomplished by movement of second member 24 in the second plane. Second member 24 is formed with an outwardly extending boss 74 forming a portion of a ball and socket joint 76 connecting second push rod assembly 14 with second member 24. Push rod assembly 14 is formed with a push rod 78 which reciprocates in a housing 80 which, in turn, is mounted on mounting bracket 16 via a bracket 82.

Figures 2, 3:
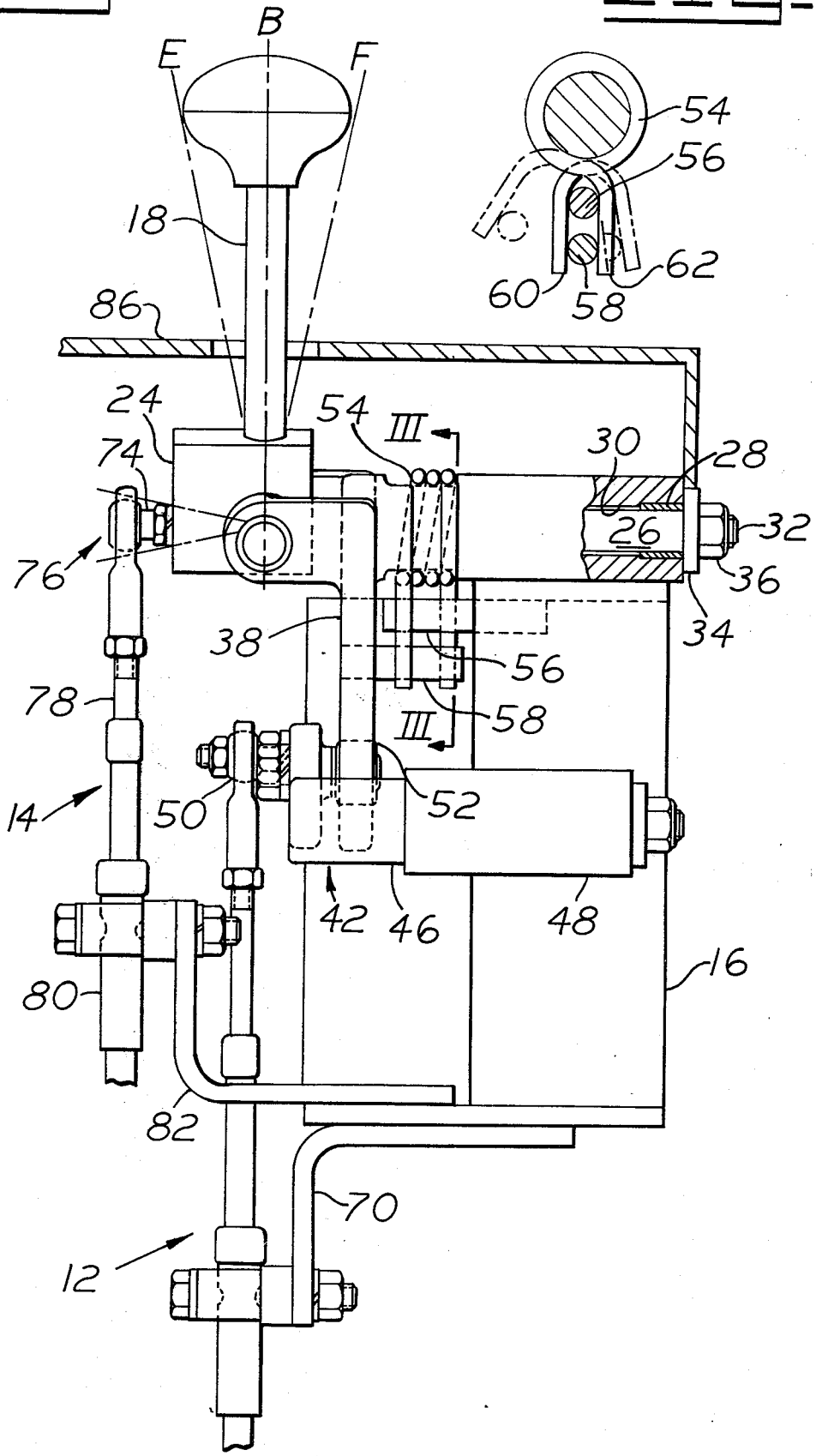
FIG. 2 is a side elevational view of the lever mechanism in FIG. 1 as seen from the right.
FIG. 3 is a sectional view taken generally at line 3—3 in FIG. 2, showing the resilient means of this lever mechanism.

Second member 24 is mounted for rotation in first member 20 so that with lever 18 mounted in second member 24, rotation of second member 24 about an axis generally normal to the plane of FIG. 2 may occur. It should be understood that without limitation by a gating plate or the like, lever 18 would be free to rotate about its mounting axis.

Figure 4:
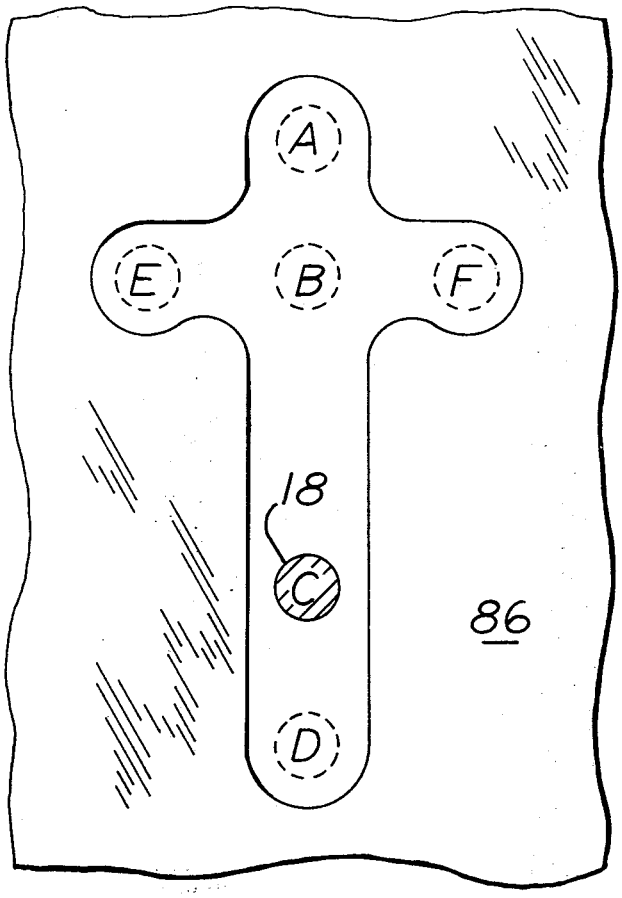
FIG. 4 is a fragmentary top view as seen from line 4—4 in FIG. 1 and showing a gating plane which would be appropriate for use in this lever mechanism.

Affixed at the top of mounting bracket 16 is a gating plate 86 seen in plan view in FIG. 4. Gating plate 86 may be modified; however, the slot illustrated in FIG. 4 is representative of one configuration only to serve to limit lever 18 to a predetermined path. Positions of lever 18 in gating plate 86 are represented by letters and corresponding positions are shown in FIG. 5 for positions A, B, C, and D.

In operation, movement of lever 18 through positions A, B, C, and D causes downward displacement of push rod 66 in consonance with the graph shown in FIG. 5 when using the cam slot illustrated in FIG. 1. It is to be understood that other cam slots may be used for other motions of push rod 66. Movement of lever 18 from position E through B to position F causes upward movement of push rod 78. As previously noted, the resilient member 54 centers lever 18 in the central or neutral position C. It should be apparent that position E and F may be detented to hold the lever out of the neutral position.

Although this invention has been described in relation to a particular cam slot and associated with hydraulic systems, it is to be understood that it is equally applicable to other systems and is limited only by the following claims.

Embodiments of the invention in which an exclusive property or privilege is claimed are defined as follows:

1. A lever mechanism comprising:

a bracket;

a lever operatively mounted on said bracket for movement relative to said bracket in first and second generally normally oriented planes;

cam means associated with said lever for movement therewith in said first plane;

a first apparatus associated with said bracket for reciprocal movement relative said bracket;

a cam follower lever pivotally connected to said bracket and associated with said first apparatus;

a cam follower mounted on said lever and responsive to said cam means for reciprocally moving said first apparatus in response to movement of said lever in said first plane, said cam follower mounted on said cam follower lever intermediate the connection of said cam follower lever with said bracket and the association of said cam follower lever with said first apparatus;

a second apparatus associated with said bracket and responsive to movement of said lever in the second plane for reciprocal movement independent of said first apparatus; and resilient means for biasing said lever to a center neutral position in said first plane.

2. The lever mechanism of claim 1 further comprising a slotted gating plate circumjacent the lever for limiting movement of the lever.

3. The lever mechanism of claim 2 further comprising means for mounting said lever for swinging movement relative to said bracket.

4. The lever mechanism of claim 3 wherein the means for mounting the lever comprises a first member pivotally associated with the bracket for rotation about a first axis in the first plane relative said bracket and a second member pivotally mounted on said first member for rotation about a second axis normal to said first axis and lying in the second plane;

and wherein the cam means is affixed to said first member and the second apparatus is associated with said second member.

5. The lever mechanism of claim 3 wherein the lever is fixedly associated with the second member.

6. The lever mechanism of claim 5 wherein the first member is bifurcated and further wherein said second member is mounted for rotation between the bifurcated portions of said first member.

7. The lever mechanism of claim 4 wherein the cam means comprises a plate defining a cam slot, said plate integrally formed with the first member.

* * * * *